US006572391B2

(12) United States Patent
Mochizuki et al.

(10) Patent No.: US 6,572,391 B2
(45) Date of Patent: Jun. 3, 2003

(54) COMPACT CONNECTOR SYSTEM WITH ENGAGEMENT LEVER HAVING INCREASED ROTATION

(75) Inventors: Shinji Mochizuki, Shizuoka-ken (JP); Kentaro Nagai, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/939,758

(22) Filed: Aug. 28, 2001

(65) Prior Publication Data

US 2002/0025712 A1 Feb. 28, 2002

(30) Foreign Application Priority Data

Aug. 31, 2000 (JP) ..... P2000-262868

(51) Int. Cl.[7] ..... H01R 13/62
(52) U.S. Cl. ..... 439/157; 439/310
(58) Field of Search ..... 439/157, 153, 439/152, 310, 372

(56) References Cited

U.S. PATENT DOCUMENTS 5,576,938 A * 11/1996 Beun ..... 174/50
6,390,835 B1 * 5/2002 Okabe et al. ..... 439/157

FOREIGN PATENT DOCUMENTS

JP 10-21992 1/1998

* cited by examiner

*Primary Examiner*—Tulsidas Patel
*Assistant Examiner*—Chandrika Prasad
(74) *Attorney, Agent, or Firm*—Finnegan, Henderson, Farabow, Garrett & Dunner, L.L.P.

(57) ABSTRACT

A first connector (3) includes: a first housing (12); and a pair of rotary members (13) supported on the first housing (12) for rotating in opposite directions to each other. Rotary members (13) each include: a first engagement member (21, 22); and a second connector (4) configured to be mated with the first connector (3). The second connector (4) includes a second housing (27) configured to be mated with the first housing (12). The second housing (27) includes a pair of first mating engagement members (36). First mating engagement members (36) are each configured to be abutted on the first engagement member for rotating a rotary member (13) and to be locked with the first engagement member (21, 22). The second housing (27) includes a pair of cuts (35). Cuts (35) each are for inserting the rotary member (13) thereinto when the rotary member (13) rotates.

9 Claims, 13 Drawing Sheets

COMPACT CONNECTOR SYSTEM WITH ENGAGEMENT LEVER HAVING INCREASED ROTATION

BACKGROUND OF THE INVENTION

The present invention relates to a connector system, and, more specifically, to a connector system for supporting and fixing joined mating internal and external connectors to a mounting component.

SUMMARY OF THE INVENTION

An object of the present invention is to provide a connector system for increasing the amount of rotation without increasing the length of an engagement lever.

To achieve the object, and according to a first aspect of this invention, a connector system is provided that includes a first connector, which includes a first housing and a pair of rotary members supported on the first housing for rotating in opposite directions to each other. Each of the rotary members includes a first engagement member. The connector system also includes a second connector configured to mate with the first connector. The second connector includes a second housing configured to mate with the first housing and a pair of first mating engagement members. Each of the first mating engagement members is configured to abut the first engagement member for rotating a rotary member and to lock with the first engagement member. The second housing has a pair of slits. A rotary member can be inserted into each of the slits, depending on its rotational position.

Preferably, each of the first engagement members includes a first protrusion configured to abut on a first mating engagement member. When the rotary member rotates, the first protrusion rotates on the first mating engagement member. Each of the first engagement members includes a second protrusion separate from the first protrusion at a rotational angle. The second protrusion is configured to move around the rotary member and oppose the first protrusion, relative to the first mating engagement member, when the rotary member rotates.

Preferably, each pair of rotary members includes a second engagement member configured to lock with a mounting object. The second engagement member can slide against the mounting object when the rotary member rotates.

Preferably, the second engagement member is opposed to the first engagement member relative to a rotational axis of the rotary member.

Preferably, each rotary member includes a locking member locked with the first housing. The locking member disengages when the first housing is mated with the second housing.

Preferably, rotary members include respective gears that mesh with each other.

Preferably, rotary members include respective biasing members biased against each other.

According to a second aspect of the invention, a connector system is provided that includes a first connector having a rotatable engagement lever and a second connector that can be mated with the first connector. The second connector has a housing formed with a slit and can rotate a free end of the engagement lever for insertion into the slit.

Preferably, when the free end of the engagement lever is locked with a mounting component, and the second connector is pressed into the first connector, the first connector is inserted into the housing. Then, a rotation of the engagement lever causes the first and second connectors to mate.

When the first connector is mated with the second connector, the engagement lever rotates a side portion of its free end into the slit formed in the housing of the second connector. This configuration allows the engagement lever to increase its rotational motion, thereby enlarging the amount of the mating movement without requiring the lengthening of the engagement lever.

When the first connector mates with the second connector, the side portion of the free end supported by the first connector is inserted into the slit formed in the second connector.

BRIEF DESCRIPTION OF THE ACCOMPANYING DRAWINGS

The above and further objects and novel features of the present invention will emerge more fully from the following detailed description when the same is read in conjunction with the accompanying drawings, in which.

DETAILED DESCRIPTION OF THE PREFERRED EMBODIMENTS

The preferred embodiment of a connector system according to the present invention is detailed below with reference to the accompanying drawings.

Figure 1:
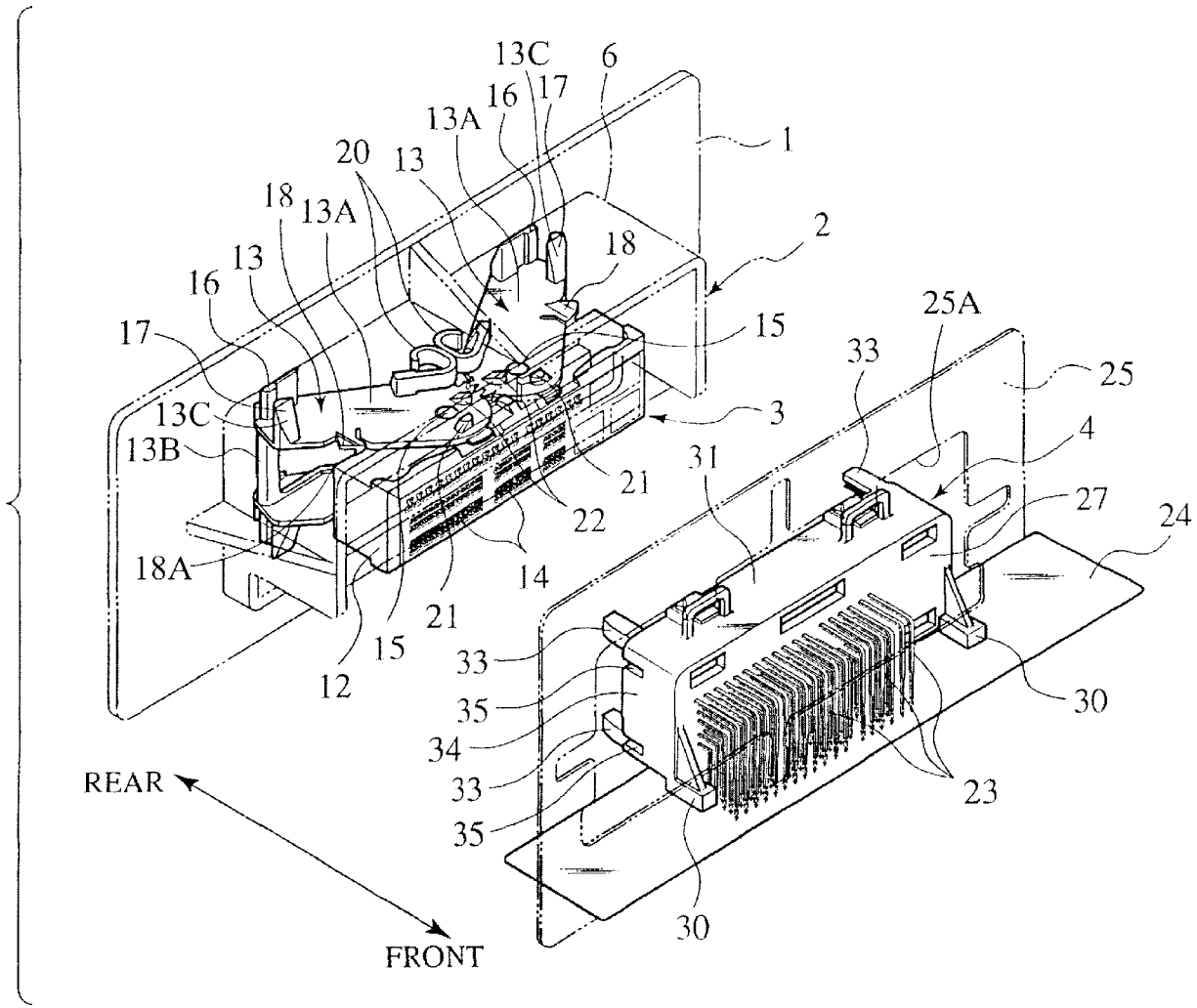
FIG. 1 is a perspective view of an embodiment of a connector system according to this invention.
Figure 2:
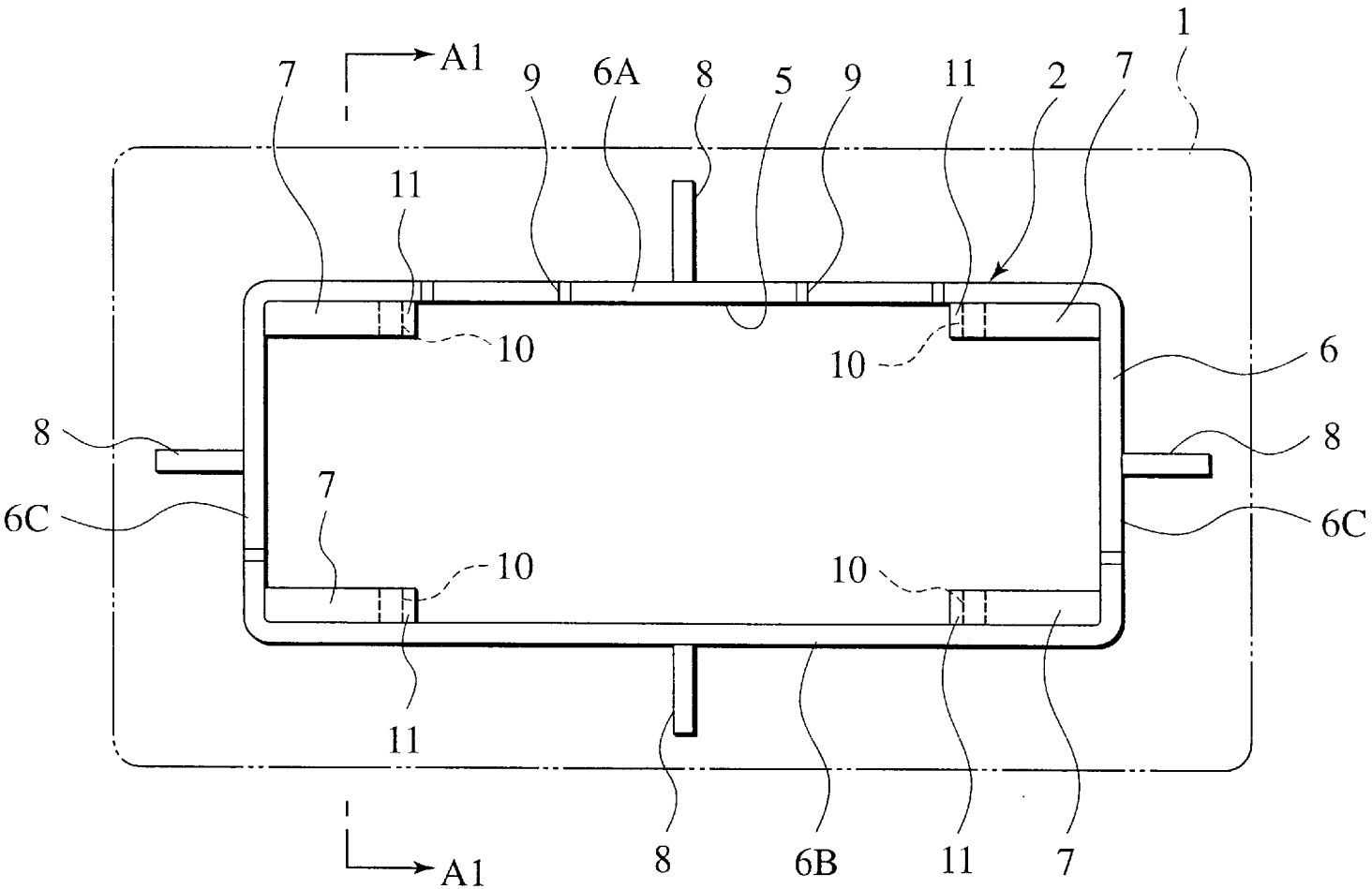
FIG. 2 is an elevational view of a mounting component of the embodiment shown in FIG. 1.
Figure 3:
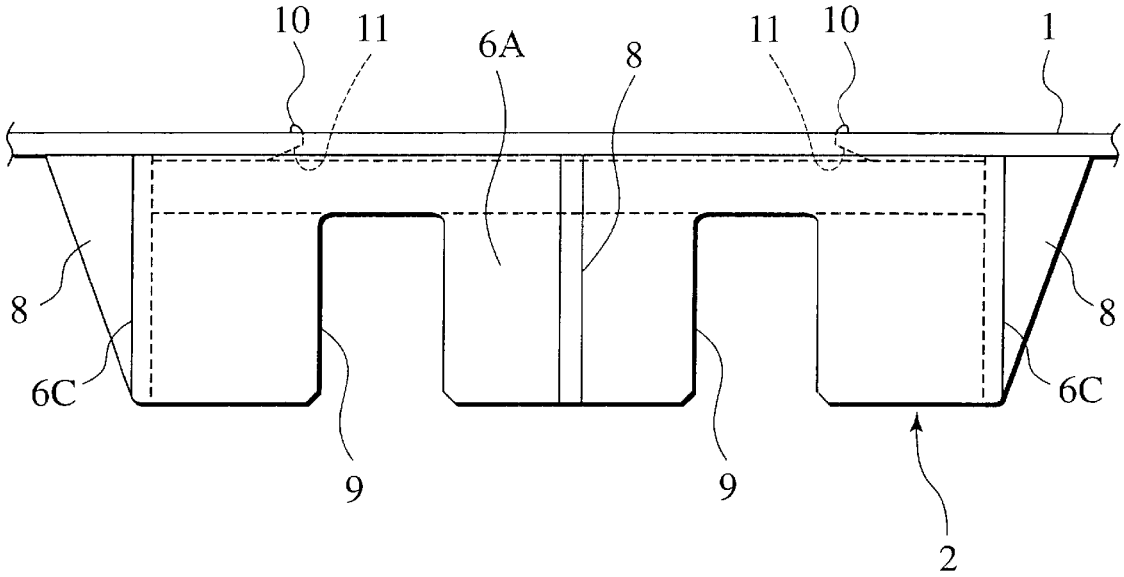
FIG. 3 is a plan view of a mounting component of the embodiment shown in FIG. 1.
Figure 4:
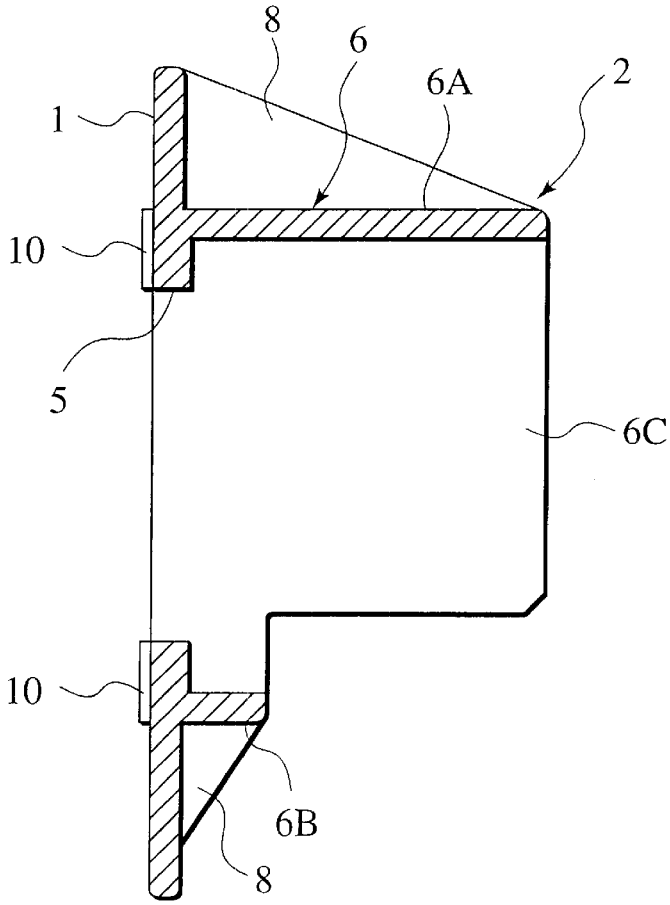
FIG. 4 is a sectional view taken along line A1—A1 of FIG. 2.

The connector system, as shown in FIG. 1, generally includes mounting component 2 formed from instrument panel 1, such as a stay member of an automobile, external connector 3 (as a first connector) mounted to mounting component 2, and internal connector 4 (as a second connector) that is mated with external connector 3.

First, mounting component 2 is described with reference to FIGS. 2–5.

Mounting component 2 includes tubular hood 6, which extends forward from the edge of rectangular opening 5, which is formed in instrument panel 1.

Engagement plates 7 are located close to and project from the side edges of either side of the upper and lower edges of opening 5. Each of plates 7 is engaged with the free end of engagement lever 13 and mounted to external connector 3, as described below.

Hood 6 includes upper plate 6A, lower plate 6B, and side plates 6C on both sides of hood 6. Reinforcement rib 8 is formed at the center of the outer side of each plate 6A, 6B, and 6C and is integral with panel 1. Upper plate 6A has a longer forward projecting dimension than lower plate 6B. Upper plate 6A includes slits 9 at both sides of rib 8.

Small locking protruding banks 10 protrude rearward and are each formed on the rear side of the side edge of engagement plate 7 facing in toward the other engagement plate 7. Each of tapered faces 11 is formed on the front side of the side edge for guiding the free end of engagement lever 13 as described later.

Second, external connector 3 is described.

Figure 5:
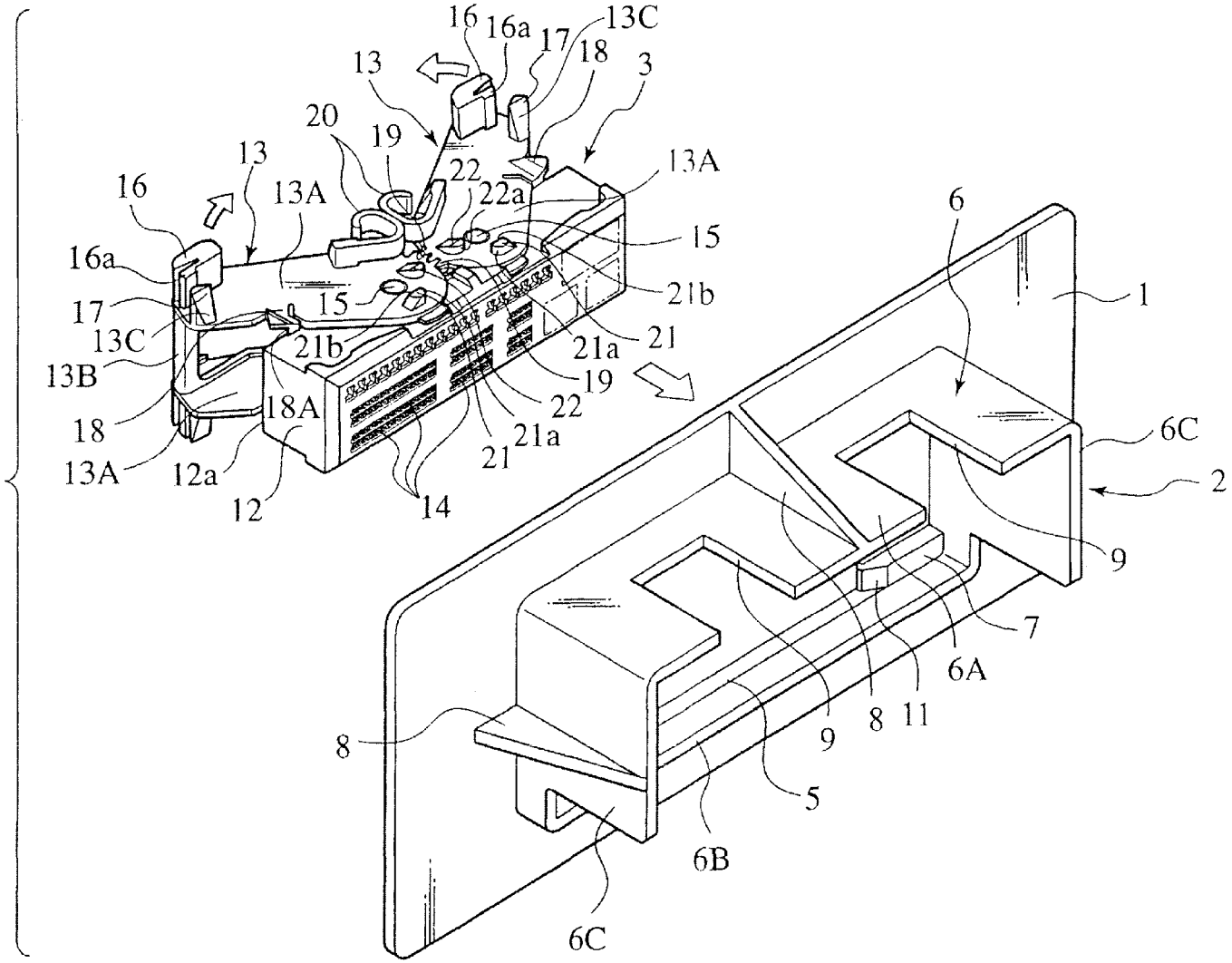
FIG. 5 is a perspective view showing internal and external connectors of the embodiment shown in FIG. 1.

External connector 3 includes external connector housing 12, which has a substantially rectangular parallepiped shape, and a pair of engagement levers 13 that are rotatably supported by connector housing 12. As shown in FIG. 5, external connector 3 is to be inserted inside and engaged with mounting component 2 at the rear side of instrument panel 1, which is opposite the front side where hood 6 is formed.

As shown in FIGS. 1 and 5, external connector housing 12 houses external connection terminals 14. Terminals 14 are electrically connected to internal connection terminals 23 of internal connector 4 at the front side of external connector housing 23.

Support axes 15 rotatably support engagement levers 13 on the top and bottom faces of external connector housing 12, and are located to, and protrude from, the left and right at a predetermined spacing.

As shown in FIG. 5, each of engagement levers 13 includes a pair of lever plates 13A, which are identically shaped, and link parts 13B, which are integral with lever plates 13A, and form a link between lever plates 13A. Rotatable support of lever plates 13A with support axes 15, formed on the top and bottom faces of external connector housing 12, allows respective engagement levers 13 to be rotated. The free end (at link part 13B) of engagement lever 13 projects rearward from the rear end of external connector housing 12.

Rear engaging abutment projection 16 projects from the surface of the free end of lever plate 13A of each engagement lever 13. Locking part 16*a* branches and extends from the central portion of projection 16. When external connector 3 is mounted to mounting component 2, rear engaging abutment projection 16 is pressed into contact with the rear side of engagement plate 7 and locking part 16*a* locks with locking bank 10.

Front engaging abutment projection 17 is located on the forward side of rear projection 16 and on one side of a line connecting rear projection 16 and support axis 15. That is, projection 17 is located at a position that is rotationally angularly leading and radially inward. Front projection 17 has substantially identical height dimensions as rear projection 16. Rear face 17*a* of front projection 17 engages and contacts the surface of engagement plate 7 when external connector 3 is mounted to mounting component 2. Rear face 17*a* is curved to allow projection 17 and engagement bank 7 to be relatively rotated.

Provisional locking piece 18 is formed from lever plate 13A at the edge of another side relative to the line connecting rear engagement projection 16 and support axis 15. Locking piece 18 is used to provisionally lock with the rear edge of external connector housing 12. Stopper 18*a* protrudes from one side of provisional locking piece 18, contacting rear end 12*a* of external housing 12. Gears 19 are formed from opposed edges of lever plates 13A and mesh with each other. Because gears 19 are formed from adjacent lever plates 13A, lever plates 13A rotate in synchrony in opposite directions.

Lever plates 13A are each provided with resilient spring piece 20, which is a resilient member behind gear 19, leading from gear 19 at a rotational angle. Each of spring pieces 20 has a curved shape that has a width that enlarges toward the other spring piece 20. Spring pieces 20 contact each other in an initial state in which provisional locking pieces 18 are locked with the rear end of external connector housing 12. This causes spring pieces 20 to be biased for repulsion when the free ends of engagement levers 13 rotate closer to each other.

Each of lever plates 13A has engagement protrusion 21 located in front of support axis 15, protruding upwardly or downwardly at its end. Engagement protrusion 21 includes curved side face 21*a* that is directed radially outward and a flat side face 21*b* that is directed radially inward. Internal connector 4 guides engagement protrusion 21, which acts as a stopper, and prevents internal connector 4 from slipping out. Protrusion 22 is provided between support axis 15 and gear 19 of lever plate 13A and acts as the engaging abutment on engagement receiver 36. Protrusion 22 has curved end 22*a*, which is curved in a counterclockwise direction. When protrusion 22 is brought into contact with the front end of internal connector 4, lever 13 rotates due to the applied force received from internal connector 4, and moves internal connector 3 rearwardly.

Figure 6:
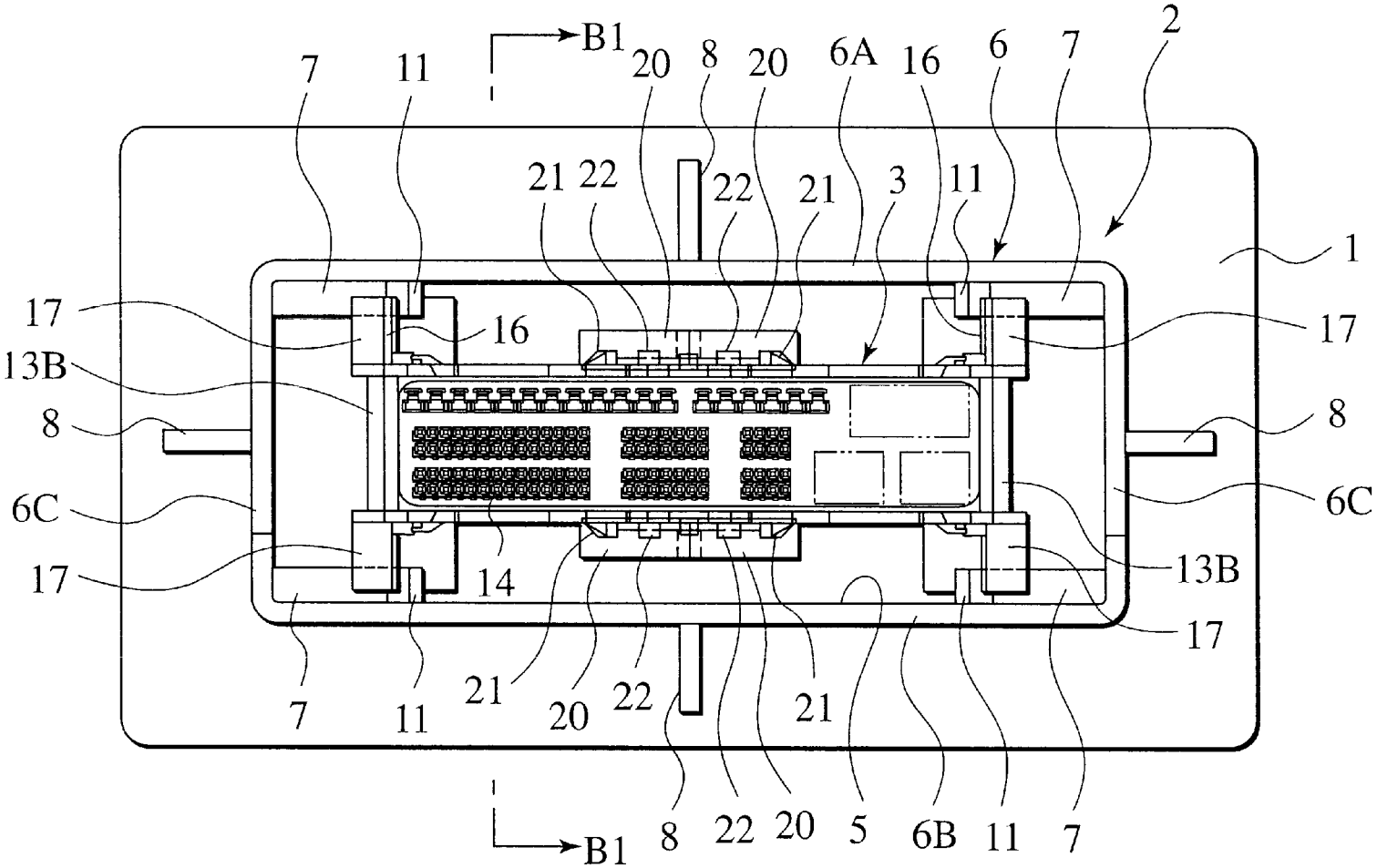
FIG. 6 is an elevational view of an external connector according to this invention that is mounted to a mounting component.
Figure 7:
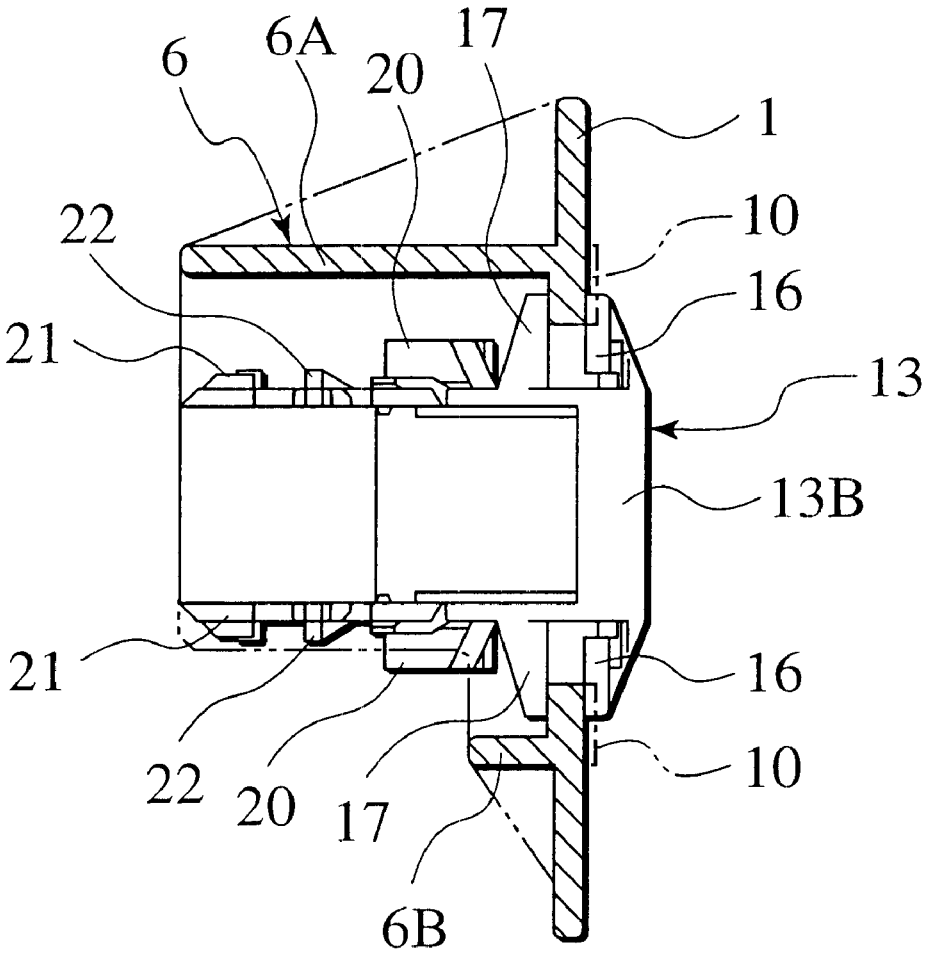
FIG. 7 is a sectional view taken along line B1—B1 of FIG. 6.

The method for assembling external connector 3 to mounting component 2 is described with reference to FIGS. 5–7. First, external connector 3, as shown in FIG. 5, is inserted at the rear side of instrument panel 1 in the direction shown by the arrow. When edges 13C of engagement levers 13 come in contact with engagement plate 7, a moment is exerted on engagement levers 13. The moment rotates engagement levers 13 about respective support axes 15 so that they come close to each other (the direction shown by the arrow in FIG. 5). Simultaneously, spring pieces 20, which are formed from engagement levers 13, contact each other and store repulsion for the detachment of the free ends of levers 13 from each other. When a force is applied that overcomes the repulsion, external connector 3 is pushed into mounting component 2, each of rear projections 16 comes in contact with the rear side of mounting plate 7, and each of front projections 17 comes in contact with the front side of mounting plate 7. This causes mounting plate 7 to be gripped between the front and rear projections 16 and 17, thus mounting external connector 3 to mounting component 2, as shown in FIGS. 6 and 7.

The embodiment employs spring piece 20 as a resilient member. On the other hand, for example, coil springs that are arranged to repulse each other or an elastic member, such as a rubber member, is also preferably used. The embodiment shown in FIG. 5, for example, has the resilient members provided on levers 13. In another preferred embodiment, the resilient member is fixed at an intermediate position between both levers 13 in external housing 12.

Third, internal connector 4 is described below.

Figure 8:
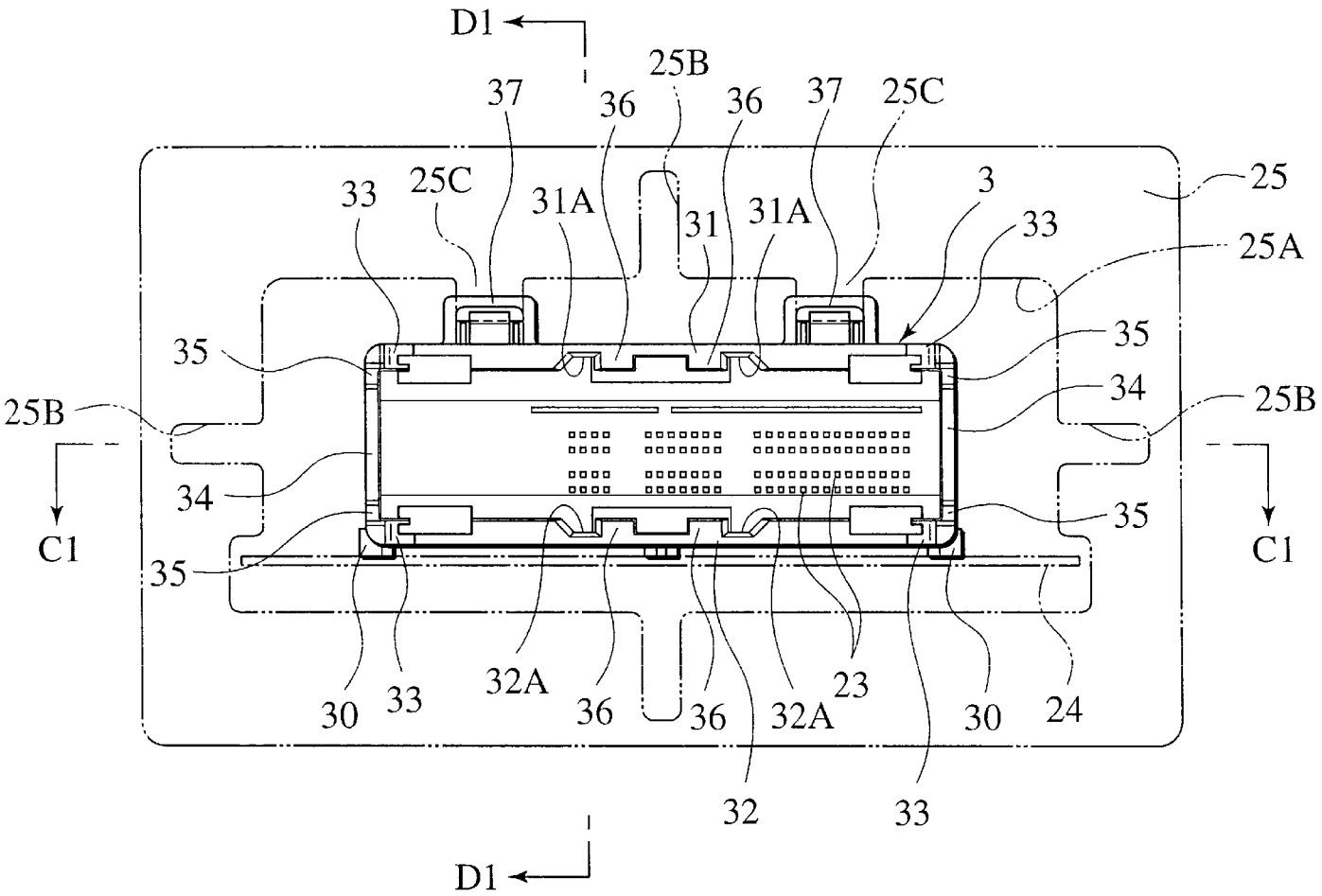
FIG. 8 is an elevational view showing the internal connector of the embodiment shown of FIG. 1.

Internal connector 4, as shown in FIGS. 1 and 8, is fixed to base plate 24 of a piece of equipment, and is exposed from opening 25A of escutcheon 25 rising at the rear of the equipment. Opening 25A of escutcheon 25 is formed with slits 25B that correspond to reinforcement ribs 8 and supporting projection 25C for supporting internal connector 4.

Figure 9:
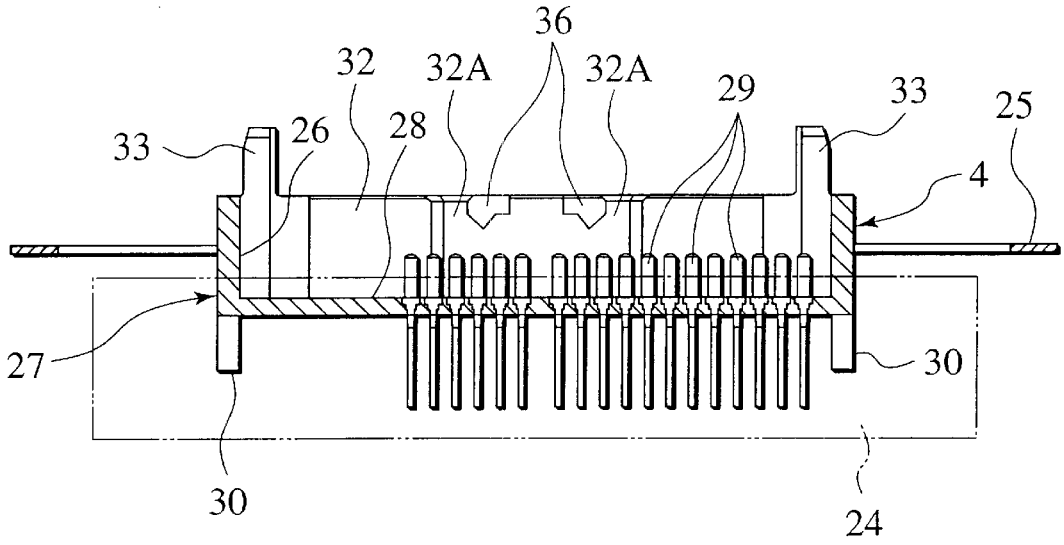
FIG. 9 is a sectional view taken along line C1—C1 of FIG. 8.
Figure 10:
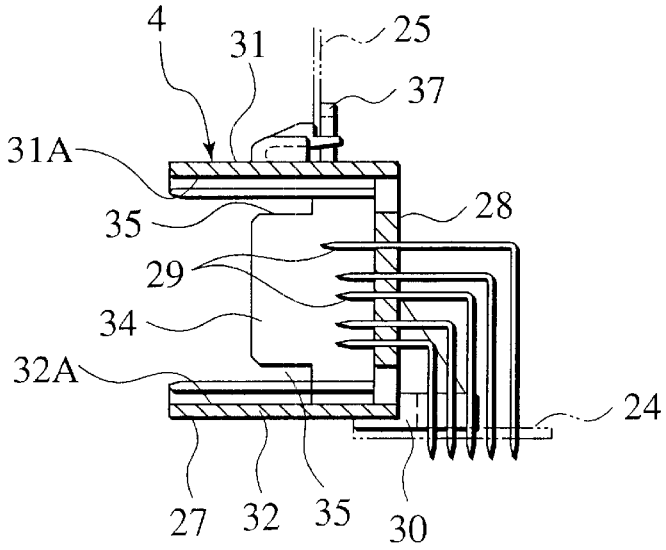
FIG. 10 is a sectional view taken along line D1—D1 of FIG. 8.

As shown in FIG. 9, internal connector 4 includes internal housing 27, which is formed on the front face with mating recess 26 to be mated with external connector 3, and internal connection terminals 29, which pass through bottom plate 28 forming the bottom of recess 26 and project into recess 26.

Both sides of the lower portion of the rear end of internal housing 27 are formed with base-plate fixing parts 30 which extend rearwardly. Arms 33, which extend forwardly and project from either side of top and bottom plates 31 and 32, are for the disengagement of provisional locking. Each of disengagement arms 33 flexes provisional locking piece 18, causing disengagement from rear end 12*a* of external housing 12 in the provisional locking state during the mating of external connector 3 and internal connector 4.

Internal housing 27 has slits 35, for insertion of levers 13. Slits 35 are cut deeply rearward at a predetermined dimension and formed at lower and upper positions on the front end face of both side plates 34.

Insertion of levers 13, which are supported by external connector 3, in slits 35, formed in side plate 34 of internal housing 34, allows an increase in the amount of rotational motion of lever 13. This geometry results in an increased amount of mating movement (extra portion for mating) of external and internal connectors 3 and 4. Thus, the amount of the rotational motion of each of engagement levers 13 is increased, rendered unnecessary a longitudinal lengthening of engagement lever 13 for increased mating movement, making engagement lever 13 more compact.

Internal wall faces of top and bottom plates 31 and 32 have respective pair of guide channels 31A and 32A that correspond to front protrusions 21 formed to external housing 12, formed thereon. Pairs of engagement receivers 36 are formed on the insides of channels 31A and 32A for engaging with front protrusions 21. Each of receivers 36 has flat side face 36*a* that is abutted on end face 22*a* of rear protrusion 22. Each of receivers 36 has another side face 36*b* oblique to and opposed to side face 36*a*. Side face 36*b* to be abutted on side face 21*a* of front protrusion 21. Each of receivers 36 also has another side face that extends from side face 36*b*, obliquely to side face 36*a*. Side face 36*c* is for sliding against side face 21*b*. Side faces 36*b* and 36*c* form an acute angle.

Each of front protrusions 21 introduced by channels 31A and 32A move in a circumferential form with side faces 36*a*, 36*b*, and 36*c*, to be engagingly abutted on engagement receiver 36.

The top face of top plate 31 of internal connector housing 27 has support protrusion 37 for fixing to support projecting piece 25C of escutcheon 25.

The aforementioned description describes a connector system of the present invention. Next, with reference to FIGS. 11–15, a method for connecting internal connector 4 to external connector 3 mounted to mounting component 2, as well as the function and operation of the connector are explained. Escutcheon 25 is omitted in FIGS. 11–15.

Figure 11:
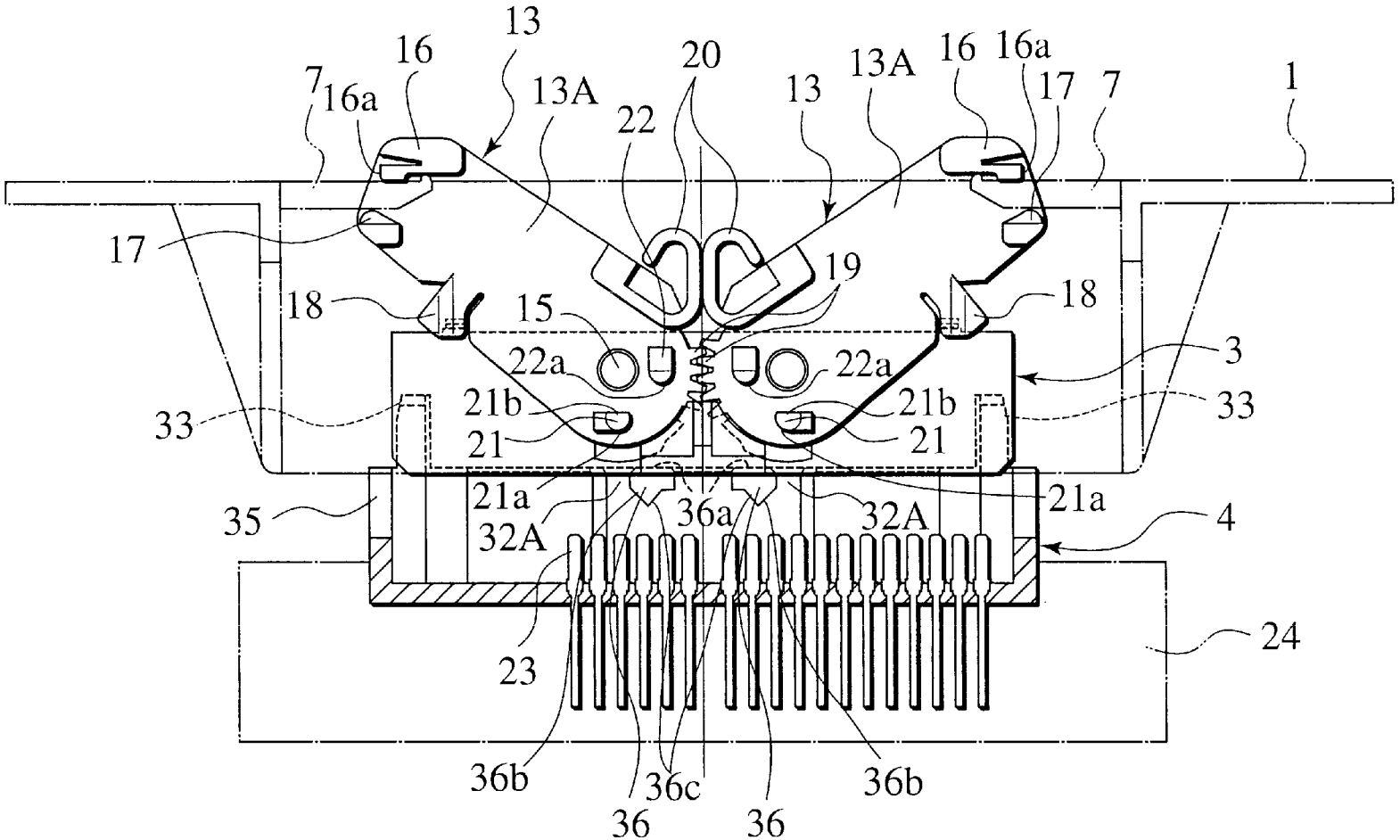
FIG. 11 is an illustrative plan view showing internal and external connectors of the embodiment shown in FIG. 1 in an initial stage of mating.
Figure 12:
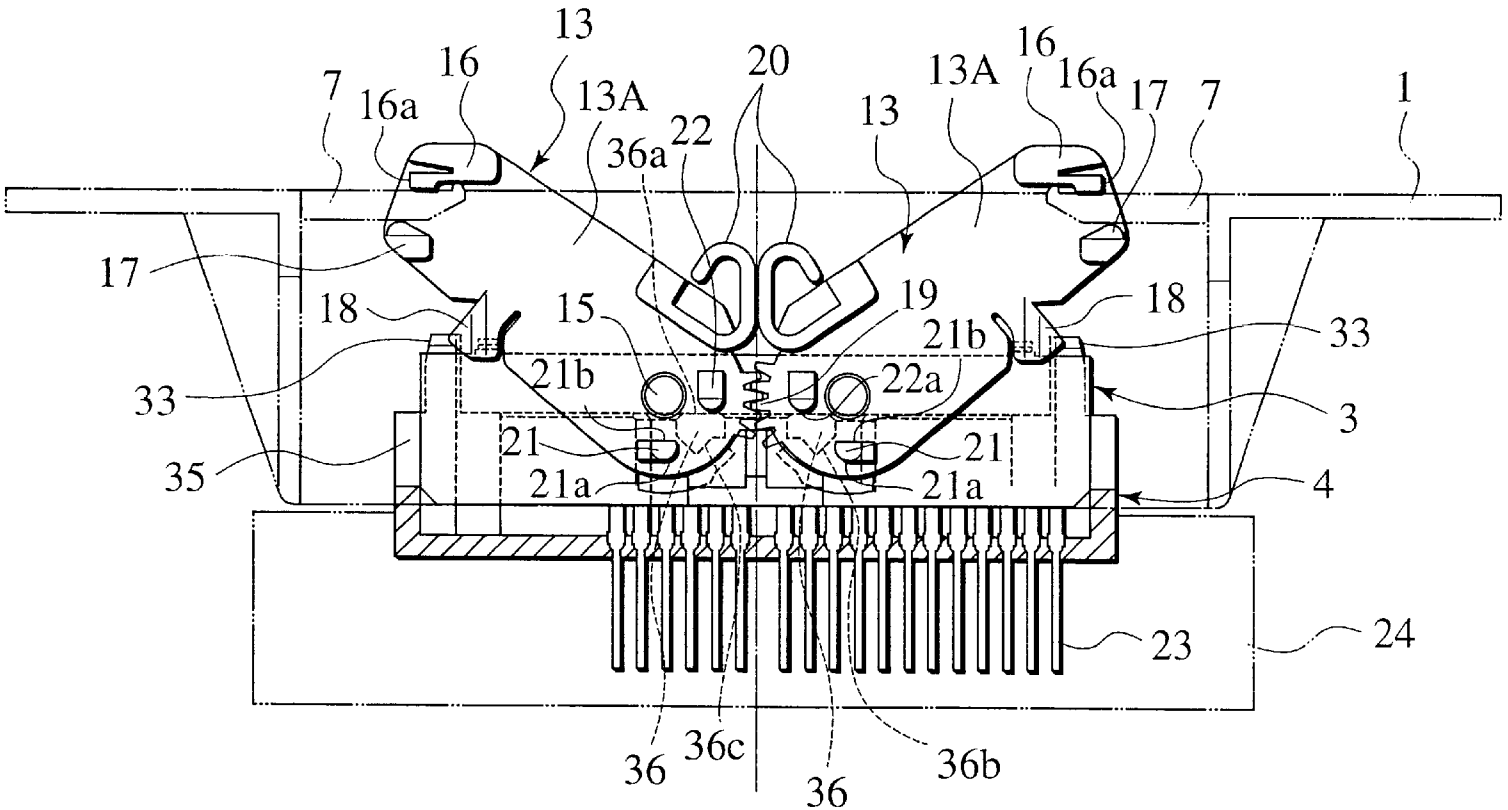
FIG. 12 is an illustrative plan view showing the internal and external connectors of the embodiment shown in FIG. 1 during mating.

First, as shown in FIG. 11, mating between internal connector 4 and external connector 3 (mounted to mounting component 2) is initiated. Here, internal connector 4 is close to external connector 3. As shown in FIG. 12, when mating begins, front protrusions 21 at the front ends of levers 13 are housed in guide channels 31A and 32A on the top and bottom internal wall faces of internal connector 4. Also, the end of each disengagement arm 33 reaches respective provisional locking piece 18.

Figure 13:
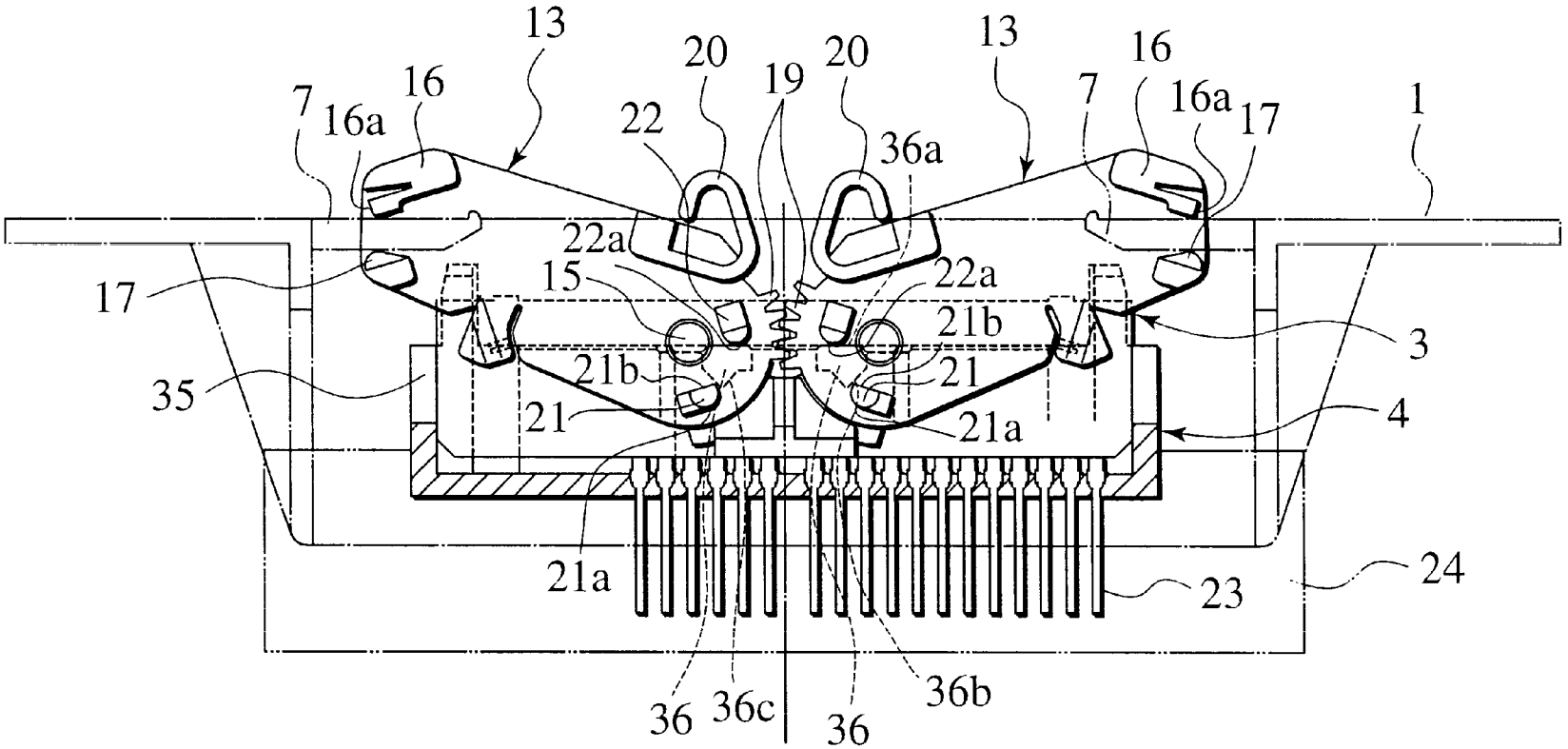
FIG. 13 is an illustrative plan view showing the internal and external connectors during mating and a provisional engaging abutment piece in a state of disengagement.

As shown in FIG. 13, when internal connector 4 is further pushed into external connector 3, end face 36*a* of receiver 36 is engagingly abutted on rear protrusion 22, which pushes end face 36*a* rearwardly. Disengagement arms 33 each flex provisional locking piece 18 and disengage them from rear end 12*a* of external connector housing 12 in a locking state. At this time, front protrusions 17, formed on the pair of engagement levers 13, are subjected to repulsion on the front face of engagement plate 7. This causes engagement levers 13 to rotate, and thereby open with respect to one another. Engagement levers 13 are meshed together by gears 19 and rotate synchronously. This causes each of front protrusions 21 to rotate and move to the rear of engagement receiver 36. In other words, front protrusion 21 rotates on its curved face 21*a*, sliding against oblique face 36*b*. Accordingly, front and rear protrusions 16 and 17 slide transversely and outwardly from engagement plate 7, respectively.

Figure 14:
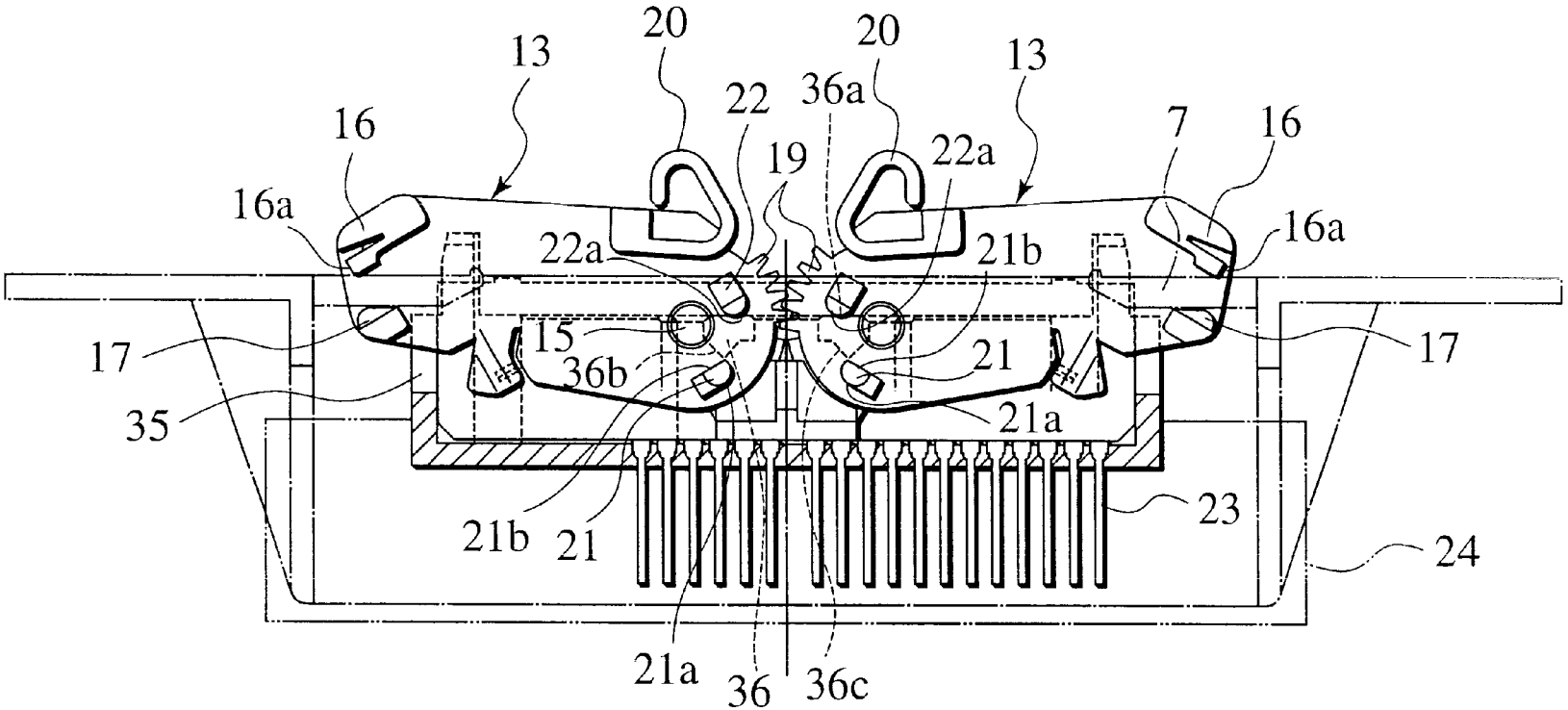
FIG. 14 is an illustrative plan view showing internal and external connectors during the mating procedure, and a lever plate that has begun to be inserted into a slit for insertion of the lever.

When internal connector 4 is further pushed, as shown in FIG. 13, spring pieces 20 separate and no longer make contact with each other. As shown in FIG. 14, each of front protrusions 21 rotate to move around toward the rear of engagement receiver 36. In other words, when the connection point between side faces 21*a* and 21*b* corresponds with the connection point of inclined face 36*b* and 36*c*, oblique face 36*c* and side face 21*b* make contact and slide against each other.

Figure 15:
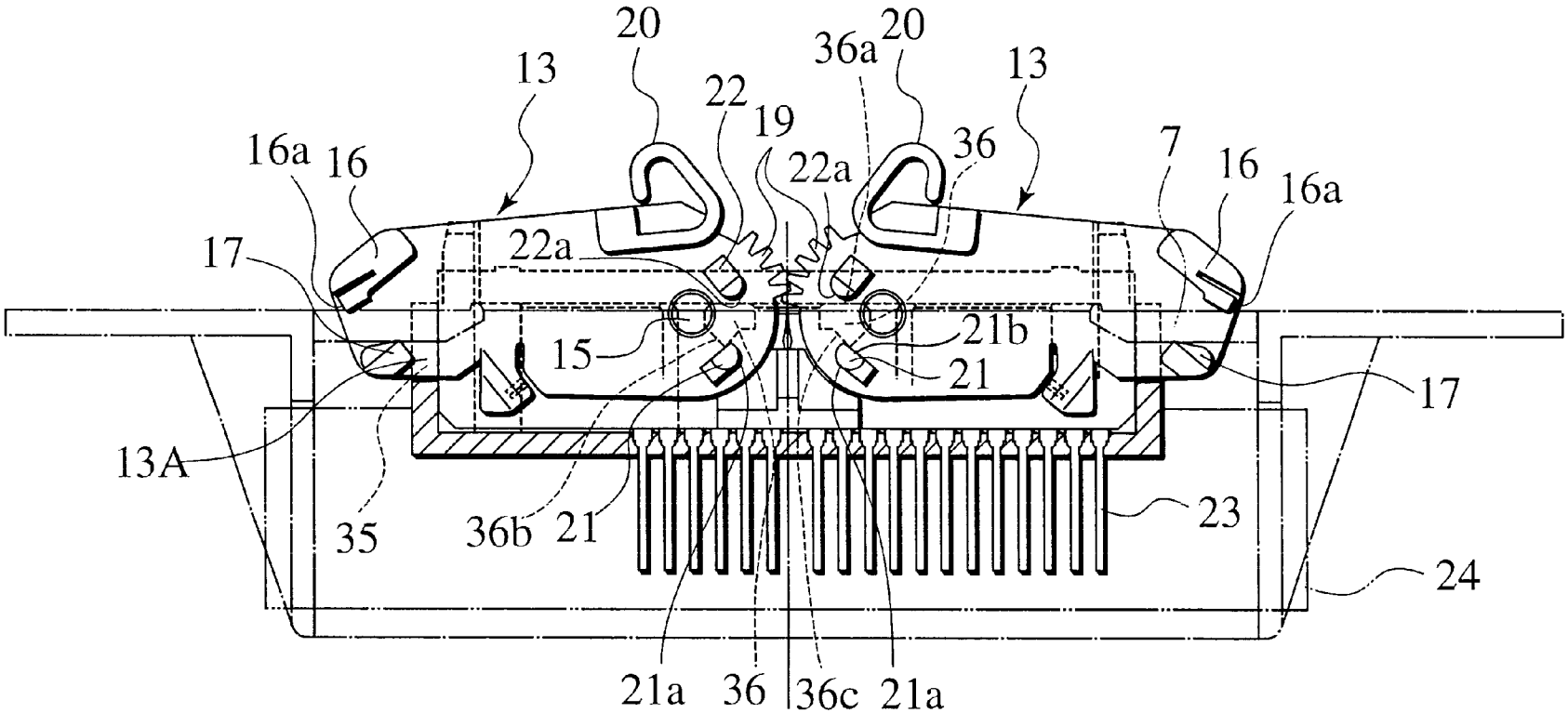
FIG. 15 is an illustrative plan view showing the internal and external connectors of the embodiment shown in FIG. 1 that are completely mated with each other.

As shown in FIG. 15, when internal connector 4 is pushed further, front protrusion 21 completely moves to the rear of receiver 36 for engagement, thereby stopping internal connector 4 from slipping out. At this time, lever plates 13A are each inserted into slit 35, preventing further mating. Mating of internal connector 4 to external connector 3, which is mounted to mounting component 2, is complete.

Thus, in this embodiment, engaging abutment of provisional locking piece 18 of lever 13 at the rear end of external connector housing 12 prevents lever 13 from rotation. Strengthening of the holding force of lever 13 in an initial state allows the secure provisional locking to be performed.

Also in this embodiment, the act of pushing internal connector 3 to mounting component 2 against a repulsion of spring piece 20 allows the automatic mounting of external connector 3 to mounting component 2, which simplifies the mounting operation of the connector.

This embodiment has gears 19 for meshing together with engagement levers 13. When an external force is applied to external connector 3, left and right engagement levers 13 distribute the force equally to mounting component 2. This advantageously helps to prevent mounting component 2 from slipping out.

Furthermore, lever plate 13A of lever 13, which is rotatably supported on external connector 3, is insertable in slit 35, which is formed in side plate 34 of internal connector housing 27. This allows an increase in the amount of the rotational motion of lever 13. Without slit 35, lever 13 must be enlarged to achieve the same amount of rotation. In this embodiment, slit 35 allows the size of lever 13 to be small, making the connector system more compact.

In addition, as shown in this embodiment, rear and front protrusions 16 and 17 securely hold engagement plate 7 therebetween depending on the rotational position of lever 13. This prevents external connector 3 from becoming loose.

It will be appreciated that the above description is for the embodiment shown in the FIGS. The invention, however, is not limited to this embodiment. For example, although the shown embodiment moves lever 13 on the top and bottom faces of external housing 12, either of the faces can be provided with a pair of plate-shaped engagement levers.

Also, in this embodiment, external connector 3 is shown as a first connector, and internal connector 4 is shown as a second connector. On the other hand, a first connector can be mounted to component 2 as an internal connector, and a second connector can be the external connector.

In addition, the above-described embodiment shows mounting component 2 provided by instrument panel 1, although this is not necessary.

The content of Japanese Patent Application No. 2000-262868 is incorporated herein by reference.

What is claimed is:

1. A compact connector system comprising:

a first connector comprising:

a first housing, and a pair of rotary members supported by the first housing for rotating in opposite directions, wherein each of the rotary members comprises a first engagement member and a plate; and a second connector configured to mate with the first connector, wherein the second connector comprises a second housing configured to mate with the first housing, and wherein the second housing comprises:

a pair of first mating engagement members, wherein each of the first mating engagement members is configured to abut on one of the first engagement members for rotating a respective one of the rotary members, and locking with the first engagement member, and a front end face having a pair of side plates with a pair of slits cut rearward in the pair of side plates, wherein the plates of the rotary members is insertable into the pair of slits when the rotary members rotate.

2. The connector system device according to claim 1 wherein each of the first engagement members comprises:

a first protrusion configured to abut on one of the first mating engagement members, wherein the first protrusion rotates on the first mating engagement member when the rotary member rotates; and a second protrusion that separates from the first protrusion at a rotational angle, wherein the second protrusion is configured to move around the first mating engagement member and to oppose the first protrusion, relative to the first mating engagement member, when the rotary member rotates.

3. The connector system according to claim 1 wherein each of the rotary members comprises a second engagement member configured to lock with a mounting component, wherein the second engagement member can slide against the mounting component when the rotary member rotates.

4. The connector system according to claim 3 wherein the second engagement member and a first engagement member oppose one another and are located away from a rotational axis of the rotary member.

5. The connector system according to claim 1 wherein each of the rotary members comprises a locking piece locked with the first housing, wherein the locking piece disengages when the first housing mates with the second housing.

6. The connector system according to claim 1 wherein each of the rotary members comprises a gear, and wherein the gears mesh with each other.

7. The connector system according to claim 1 wherein each of the rotary members comprises a biasing member, wherein the biasing members are biased against each other.

8. A compact connector system comprising:

a first connector having an engagement lever rotatably supported thereon, wherein the lever comprises a plate with a free end having a side portion; and a second connector configured to mate with the first connector, the second connector having a housing, wherein the housing comprises a front end face having a side plate formed with a rearwardly cut slit, the second connector configured to rotate the engagement lever for inserting the side portion of the plate of the engagement lever into the slit.

9. The connector system according to claim 8 wherein when the free end is locked to a mounting component, a pressing of the second connector to the first connector inserts the first connector into the housing, and a rotation of the engagement lever mates the first and second connectors to each other.

* * * * *